US008690272B2

(12) United States Patent
Anderson et al.

(10) Patent No.: US 8,690,272 B2
(45) Date of Patent: Apr. 8, 2014

(54) HOME APPLIANCE WITH SUPPORT LEG COVER

(75) Inventors: Maylene Anderson, Andersonville, TN (US); Clifford Henegar, Speedwell, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 16 days.

(21) Appl. No.: 13/477,133

(22) Filed: May 22, 2012

(65) Prior Publication Data

US 2013/0313957 A1 Nov. 28, 2013

(51) Int. Cl.
*A47B 91/00* (2006.01)

(52) U.S. Cl.
USPC ..... 312/351.1; 312/400; 248/188.5; 126/304 R

(58) Field of Classification Search
USPC ..... 312/351.3, 351.1, 205, 400, 410, 236, 312/280, 257.1, 272, 272.5, 210, 204; 248/188, 188.1, 188.2, 188.5, 188.8, 248/649, 650; 126/304 R, 305, 306, 304 A
See application file for complete search history.

(56) References Cited

U.S. PATENT DOCUMENTS

| | | | | | |
|---|---|---|---|---|---|
| 1,691,762 | A * | 11/1928 | Harter | 126/304 R |
| 2,755,114 | A * | 7/1956 | Becker | 403/361 |
| 2,767,944 | A * | 10/1956 | Moore | 248/634 |
| 3,229,942 | A * | 1/1966 | Nalle | 248/188.4 |
| 7,231,676 | B2 * | 6/2007 | Cloer et al. | 5/310 |
| 8,118,379 | B2 * | 2/2012 | Hong et al. | 312/351.3 |
| 2002/0139908 | A1 * | 10/2002 | Oyama et al. | 248/188.8 |
| 2005/0082447 | A1 * | 4/2005 | Chuang | 248/188.8 |
| 2005/0116134 | A1 * | 6/2005 | Lee et al. | 248/650 |
| 2005/0279895 | A1 * | 12/2005 | Lee et al. | 248/188.8 |
| 2010/0039010 | A1 * | 2/2010 | Hong et al. | 312/351.3 |
| 2011/0050064 | A1 * | 3/2011 | Phillips et al. | 312/351.3 |

* cited by examiner

*Primary Examiner* — Daniel Rohrhoff
(74) *Attorney, Agent, or Firm* — James E. Howard; Andre Pallapies

(57) ABSTRACT

A home appliance supported for floor-standing operation, the home appliance including an appliance body, a support member mounted to the appliance body for supporting the appliance on a support surface, a plurality of projections attached to the appliance body adjacent the support member, a first wall member attached to the plurality of projections and extending downwardly from the appliance body and a second wall member attached to the first wall member with the second wall member being movable relative to first wall member, with the wall members covering a side portion of the support member.

20 Claims, 10 Drawing Sheets

HOME APPLIANCE WITH SUPPORT LEG COVER

BACKGROUND OF THE INVENTION

The present invention relates broadly to home appliances that are supported on height adjustable legs and, more particularly, to a home appliance that includes a support leg cover that automatically compensates for the height adjustment of the appliance.

Home appliances, such as ranges used for cooking, are often built into a cabinet structure or situated next to another appliance. In either event, it is helpful that the range be height adjustable so that the top surface of the range can be positioned properly next to a cabinet or additional appliance. Not only is appearance affected by the relative height of neighboring structures, but the act of moving utensils, cooking items or other associated structures from one surface to the next is safer and more visually appealing when both surfaces are substantially equal in height.

In order to provide such height adjustability, many ranges are equipped with height adjustable legs. Such adjustable legs may consist of threaded cylinders that are movably mounted to the range frame at the corners of the range. Often resilient feet are applied to the threaded support members intermediate the support member and the support surface to cushion the range against external vibration as well as spreading the weight of the range over a larger contact surface thereby reducing the tendency of the bolts to pierce the support surface which is usually a kitchen floor.

In most kitchens, a clean and finished appearance is desired and with exposed threaded support members under the range, such a finished look is not achieved. It is therefore desirable to provide some form of fascia or leg support leg cover in order to conceal the unfinished appearance of the threaded support member.

Since the height of the range is adjustable, and with a threaded support member the adjustability is practically infinite over a narrow range, it is difficult to provide an effective support leg cover that does not expose the support leg at some range height.

SUMMARY OF THE INVENTION

It is accordingly an intent of the present invention to provide a support leg cover that accommodates height adjustability of a home appliance, such as a range.

It is another intent of the present invention to provide such a support leg cover that can be attached without lifting or tilting the range and can be installed from the front of the range.

It is further an intent of the present invention to provide a support leg cover that can be moved out of the way when leveling the range and is self-adjusting.

It is another intent of the present invention to provide such a support leg cover that snaps into place without complex fasteners.

To those ends, the present invention is directed to a home appliance supported for floor-standing operation including an appliance body, a support member mounted to the appliance body for supporting the appliance on a support surface and a plurality of projections attached to the appliance body adjacent the support member. A first wall member is attached to the plurality of projections and extends downwardly from the appliance body. A second wall member is attached to the first wall member, with the second wall member being movable relative to first wall member, and with the wall members covering a side portion of the support member.

Preferably, the plurality of projections are mounted to a platform that is mounted to the appliance body adjacent the support member and extends in different directions away from the support member.

The home appliance preferably further includes two projection supports extending downwardly from the platform with each of the projection supports having a projection mounted thereto for removable engagement with the first wall member.

It is preferred that the platform is a generally planar member mounted to the support member and having two side walls projecting downwardly from lateral edges thereof with the two side walls carrying the plurality of projections.

Preferably, the first wall member has a plurality of holes configured for engagement with the plurality of projections, with one projection removably engaged with one hole in the first wall member. It is further preferred that the second wall member is telescopically attached to the first wall member for movement of the second wall member relative to the first wall member.

It is preferred that the first wall member includes a generally vertical front wall and two side walls projecting away from the front wall defining a structure having an open back. Further, the second wall member preferably includes a generally vertical front wall and two side walls projecting away from the front wall defining a structure having an open back.

It is further preferred that the second wall member includes a generally vertical front wall and two side walls projecting away from the front wall defining a structure having an open back and the second wall member is received telescopically within the first wall member for sliding movement of the second wall member relative to the first wall member.

Preferably, the support member is vertically adjustable to provide height adjustment for the appliance and the second wall member is vertically movable to cover the support member over a plurality of appliance heights.

The present invention is also directed to a range for cooking. There, a range supported for floor-standing operation includes a range body, a support member mounted to the range body for supporting the range on a support surface and a plurality of projections attached to the range body adjacent the support member. A first wall member is attached to the plurality of projections and extends downwardly from the range body and a second wall member is attached to the first wall member with the second wall member being movable relative to first wall member, and with the wall members covering a side portion of the support member.

It is preferred that the plurality of projections are mounted to a platform that is mounted to the range body adjacent the support member and extends in different directions away from the support member. The present invention further preferably includes two projection supports extending downwardly from the platform with each of the projection supports having a projection mounted thereto for removable engagement with the first wall member.

Preferably, the platform is a generally planar member mounted to the support member and having two side walls projecting downwardly from lateral edges thereof with the two side walls carrying the plurality of projections.

It is preferential that the first wall member has a plurality of holes configured for engagement with the plurality of projections, with one projection removably engaged with one hole in the first wall member. Further, the second wall member is preferably telescopically attached to the first wall member for movement of the second wall member relative to the first wall member.

Preferably, the first wall member includes a generally vertical front wall and two side walls projecting away from the front wall defining a structure having an open back. It is further preferred that the second wall member includes a generally vertical front wall and two side walls projecting away from the front wall defining a structure having an open back.

It is further preferred that the second wall member includes a generally vertical front wall and two side walls projecting away from the front wall defining a structure having an open back and the second wall member is received telescopically within the first wall member for sliding movement of the second wall member relative to the first wall member.

Preferably, the support member is vertically adjustable to provide height adjustment for the range and the second wall member is vertically movable to cover the support member over a plurality of range heights.

DESCRIPTION OF THE PREFERRED EMBODIMENT

Figure 1:
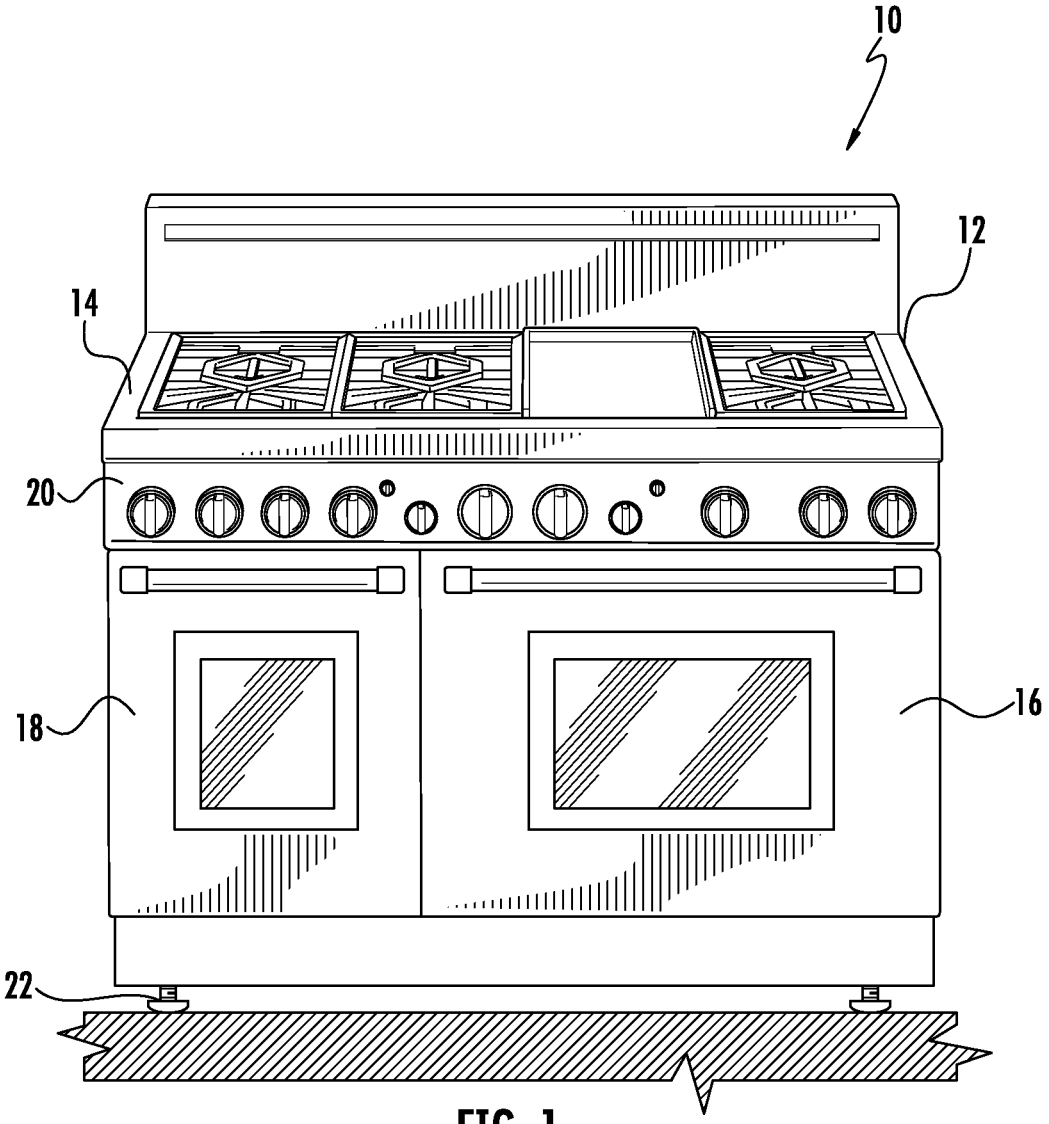
FIG. 1 (PRIOR ART)
FIG. 1 is a front view of a home appliance having exposed support legs according to the prior art.

Turning now to the drawings and more particularly to FIG. 1, a home appliance in the form as a range is illustrated generally at 10 and includes a prior art support structure 22. The range 10 includes a floor-standing box-like range body 12 having a cooktop 14 mounted on an upper portion of the range body 12. The range body 12 defines dual cavities (not shown) for cooking which may include a steamer compartment and an oven. Both cavities are covered by doors 16, 18. A control panel 20 extends the width of the range body 12 intermediate the cooktop 14 and the doors 16, 18. The entire structure is supported on a support surface, such as a floor using support members 22. Typically, the support members 22 include threaded cylinders such as bolts that are threadedly engaged with the range frame and project downwardly toward the floor with feet attached to spread the weight of the range and to protect the floor. The height of the range may be adjusted by rotating the support legs inwardly or outwardly, with respect to the range frame. Even though the height adjustment arrangement is effective, the range remains with an unfinished appearance with the threaded support members 22 exposed to view.

Figure 2:
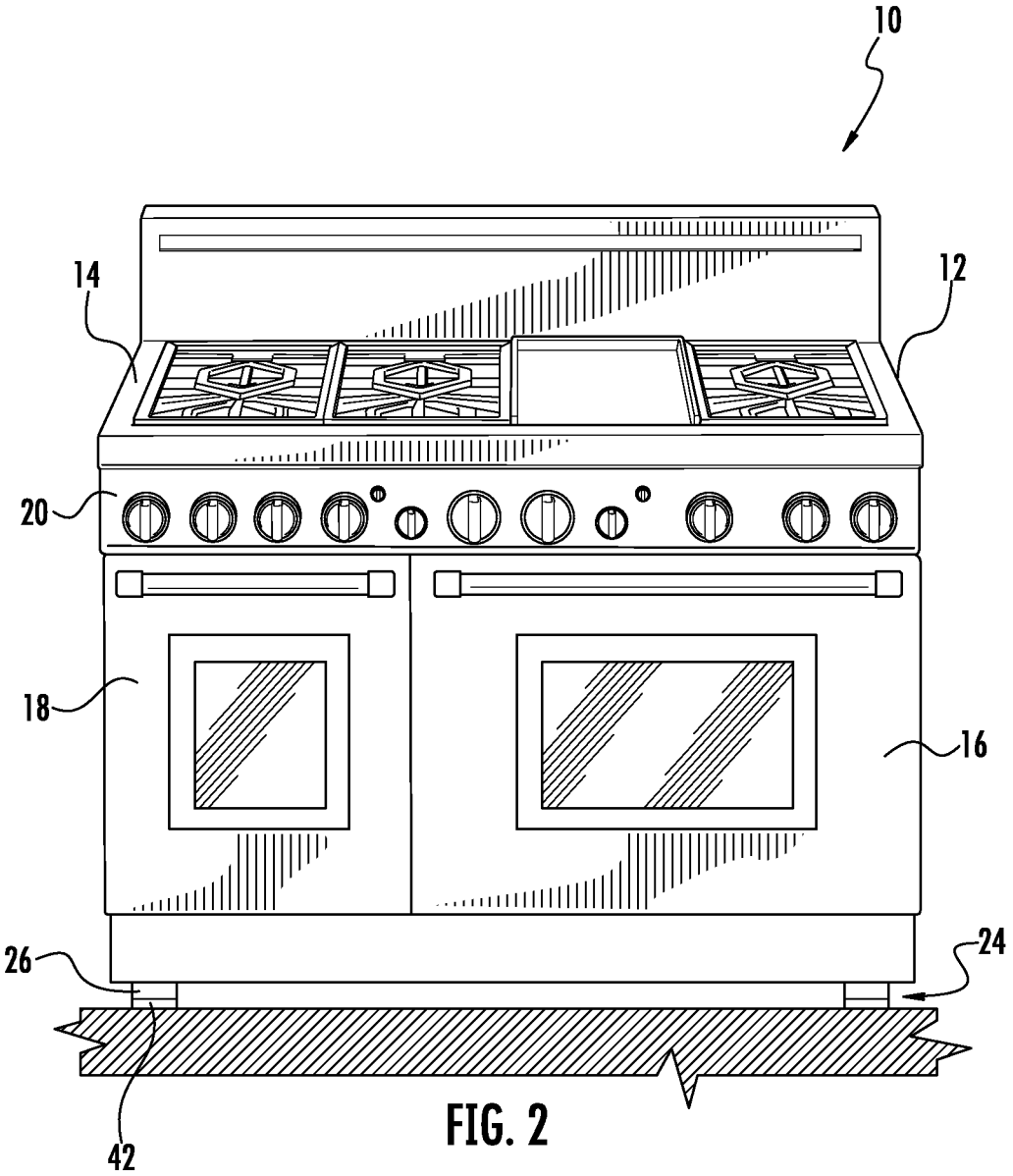
FIG. 2 is a front view of a home appliance according to the preferred embodiment of the present invention.

The present invention according to the preferred embodiment is illustrated in FIG. 2 fitted to a range 10 as generally depicted in FIG. 1. As seen in FIG. 2, leg support covers 24 in the form of a first wall member 26 having a second wall member 42 fitted telescopically therein not only provide a finished look to the range 10 but do so in a manner that makes installation a straightforward matter and conforms to any and all height adjustments possible with the range 10.

Figure 3:
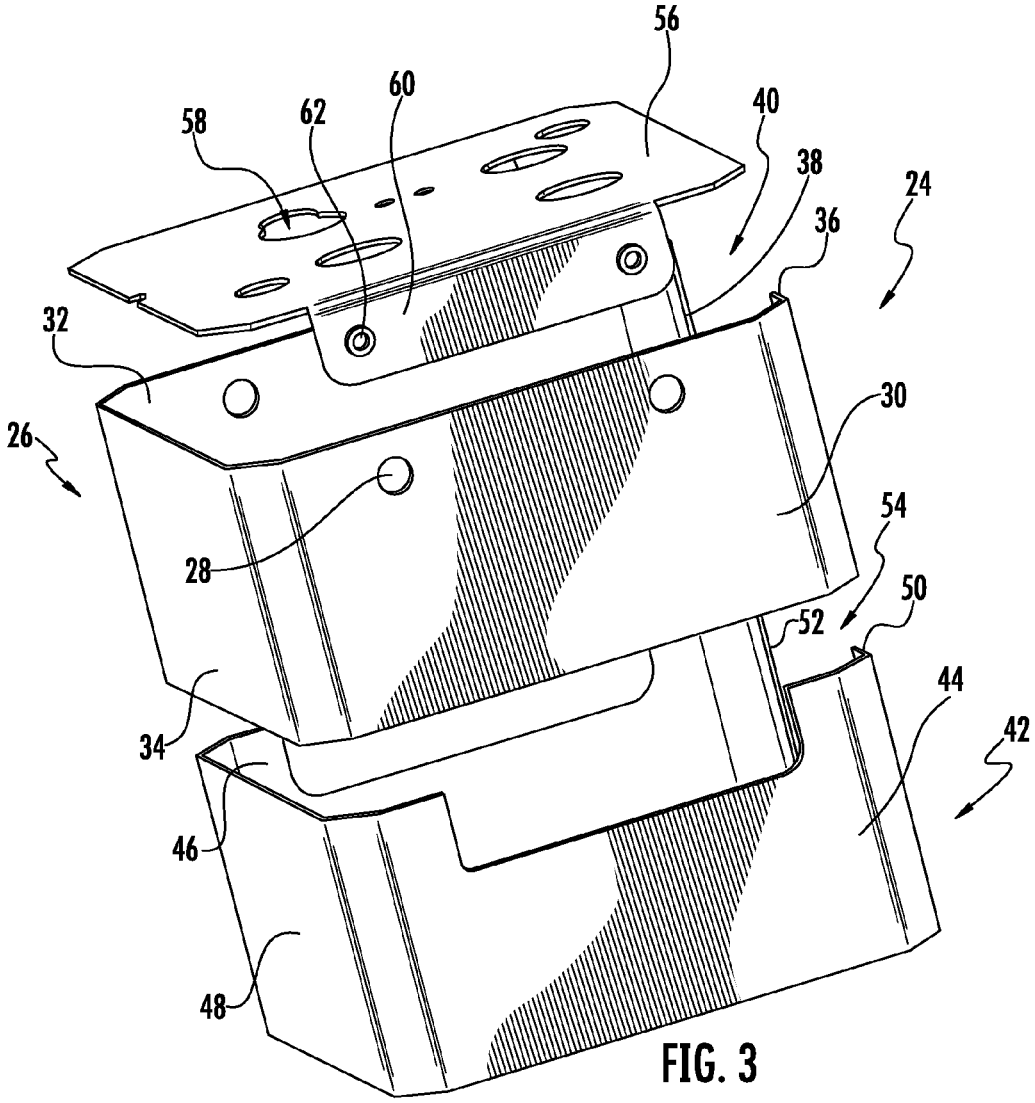
FIG. 3 is an exploded view of a support leg cover according to the preferred embodiment of the present invention.

Turning now to FIG. 3, the support leg cover is illustrated generally at 24 and includes a planar platform 56, a first wall member 26 and a second wall member 42. The planar platform 56 is formed with a number of openings 58. Some of these openings are configured to pass the threaded cylindrical support leg therethrough for mounting the platform 56 to the range 10. Side walls 60 project down and away from the generally rectangular platform 56 and two projections 62 are on each of the side walls 60.

The first wall member 26 is formed as a generally three-sided structure having a front wall 34 and two side walls 30, 32 projecting generally perpendicularly away from the front wall 34. Two short rear walls 36, 38 extend inwardly toward one another from each of the side walls 30, 32 in a generally perpendicularly manner so that a sharp structure is not readily engaged by installation or maintenance personnel. The short rear walls 36, 38 leave an open back 40. As seen in FIG. 3, each of the corners at the wall junctions are somewhat rounded for a smoother appearance and enhanced pliancy when the side walls 30, 32 are spread slightly for installation. Openings 28 are provided in the side walls at positions configured to engage the projections 62.

The second wall member 42 is formed similarly to the first wall member 26 with a front wall 48 and two side walls 44, 46 projecting generally perpendicularly away from the front wall 48. Two short back walls 50, 52 project generally perpendicularly away from the side walls 44, 46 respectively and, in the manner of the first wall member 26, form an open back 54. The second wall member 42 is slightly smaller than the first wall member 26 so that it will fit telescopically inside the first wall member 26 as seen in FIGS. 5 and 6.

Figure 4:
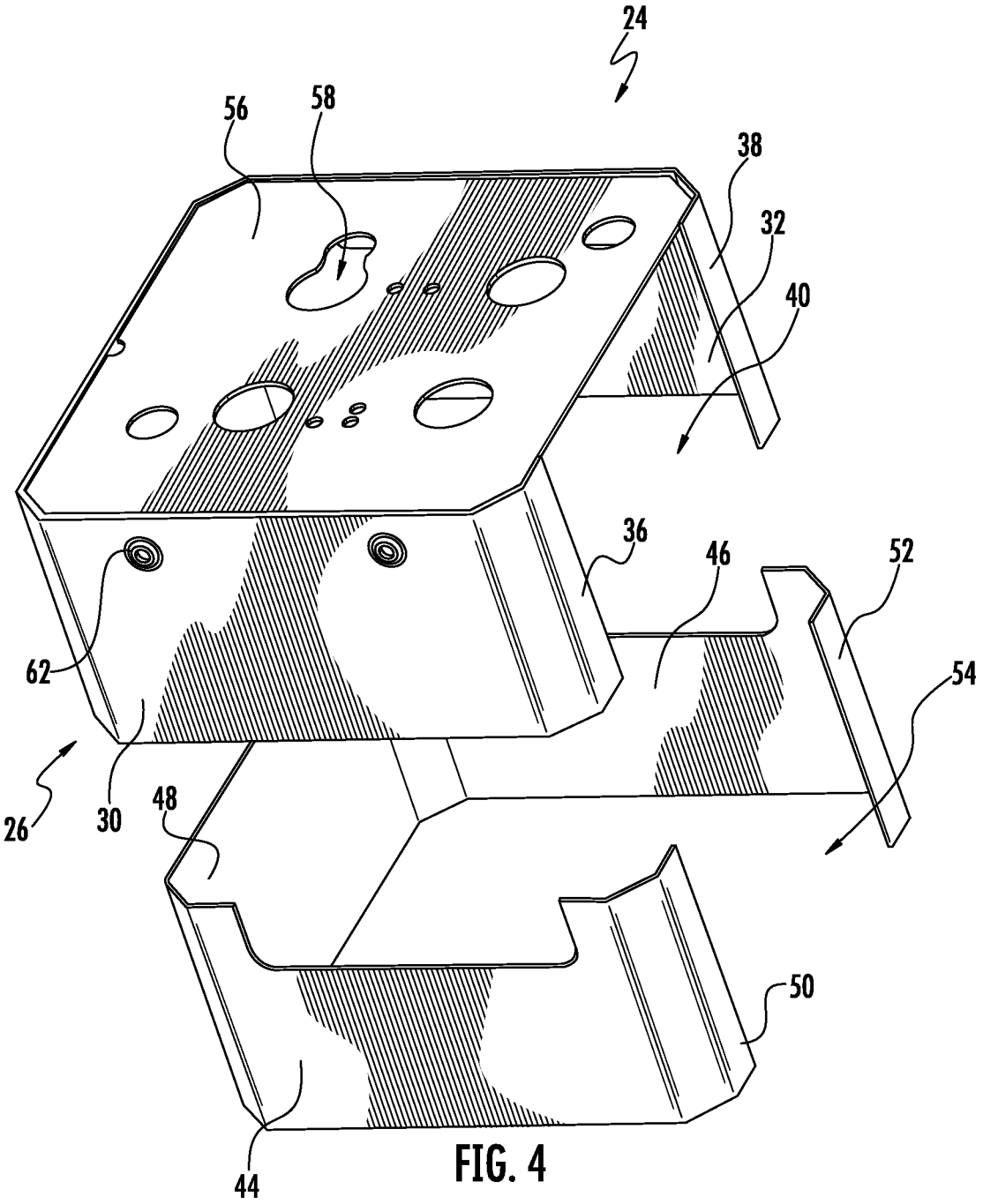
FIG. 4 is a rear exploded view of the support leg cover illustrated in FIG. 3.

Turning to FIG. 4, the first wall member 26 is attached to the platform 56 using the projections 62 fitted within the holes 28 in the first wall member 26.

Figure 5:
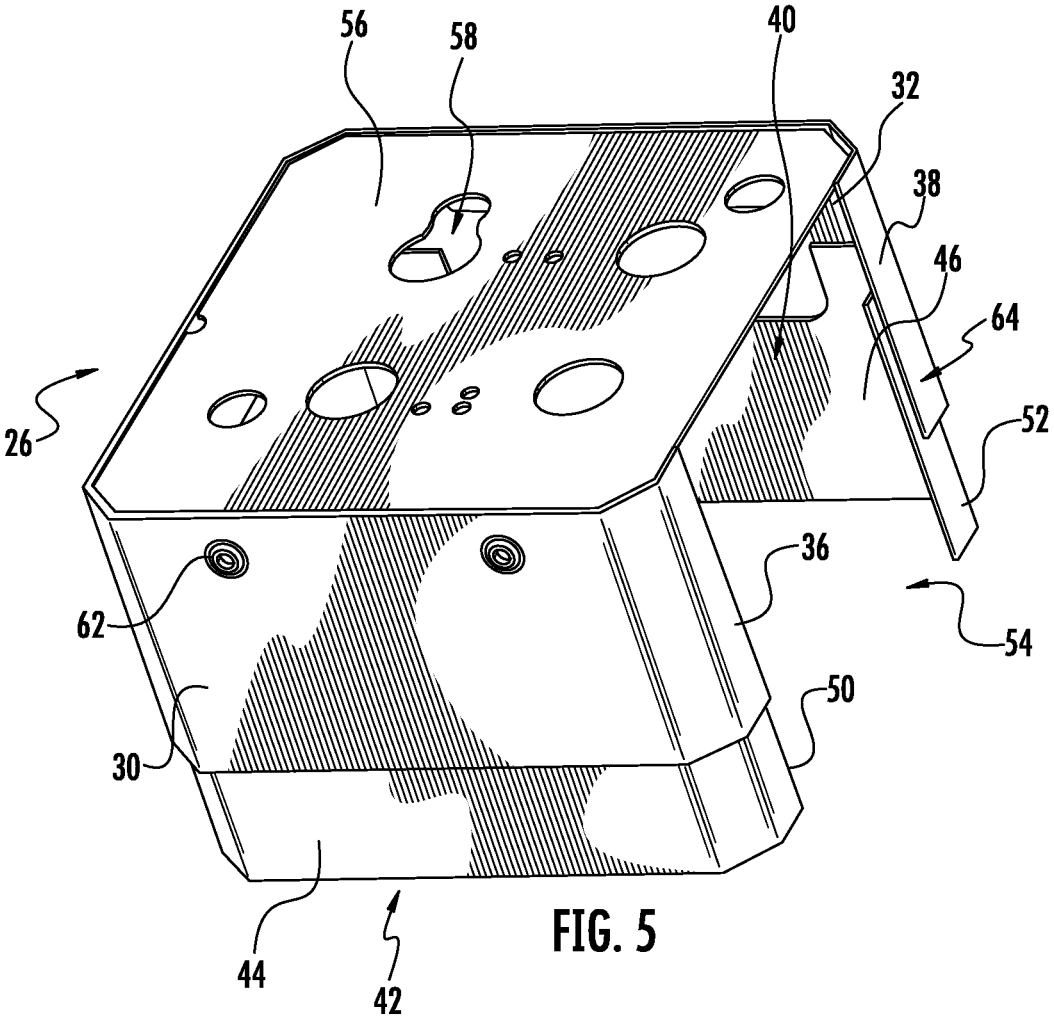
FIG. 5 is a rear perspective view of the support leg cover illustrated in FIG. 4 showing the interrelationship between the first wall member and the second wall member.
Figure 6:
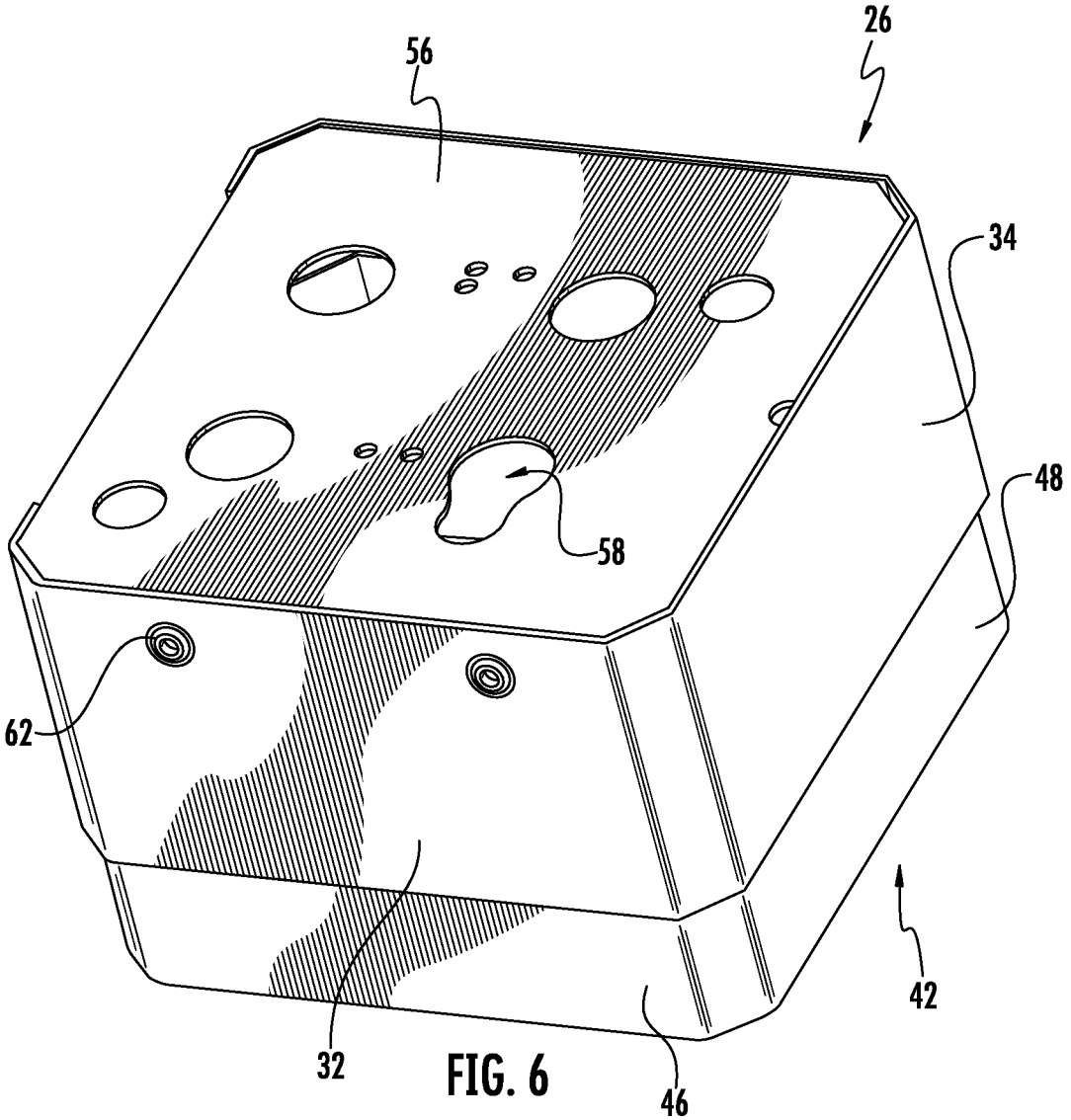
FIG. 6 is a perspective view of the support leg cover illustrated in FIG. 5.

With reference to FIGS. 5 and 6, the second wall member 44 is telescopically received within the first wall member 30 so that the second wall member 42 may move vertically relative to the first wall member 26 to thereby provide height adjustability. This assembly creates an overlapping region 64 where the second wall member 42 contacts the first wall member 26. FIG. 5 illustrates the leg support cover from the back showing the open back structure that allows the present support leg cover to be mounted to the range without lifting the range or tilting the range. FIG. 6 illustrates the leg support cover from the front and highlights the finished nature of the leg support cover providing a neat appearance for the range 10.

Figure 7:
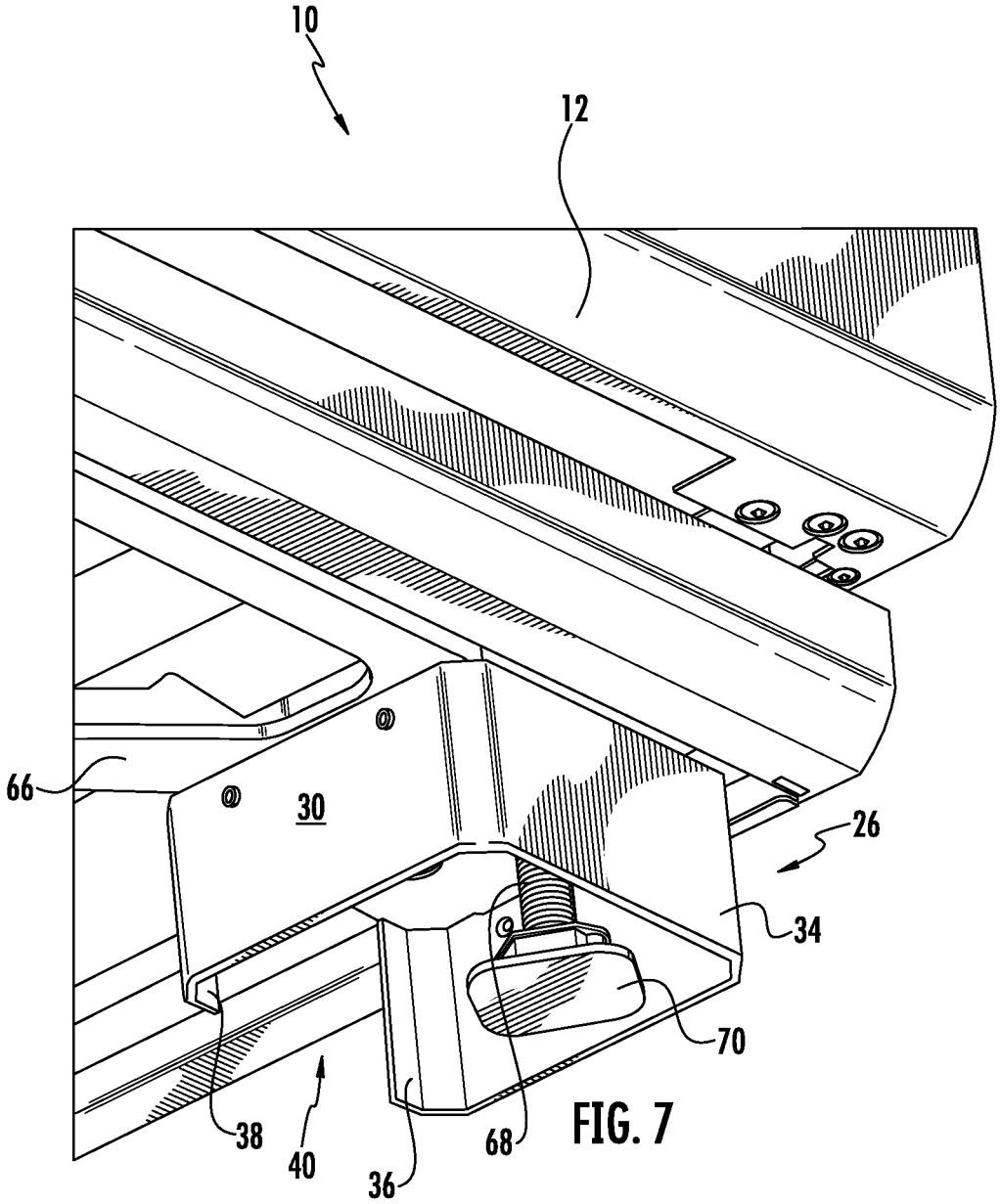
FIG. 7 is a front perspective underside view of a corner of a home appliance equipped with a support leg cover of the present invention.

FIG. 7 illustrates the relationship between the first wall member 26, the platform 56, the range body 12 and the threaded support member 68 which, includes a molded plastic foot 70 to protect the support surface, typically a kitchen floor, and to provide enhanced support for the range 10. There, the platform 56 is mounted to the range frame 66 using the threaded support member 68 through one of the holes 58 in the platform 56 as seen in FIG. 3. Returning to FIG. 7, the first wall member 26 is snapped in place by spreading the side walls 30, 32 slightly and engaging the projections 62 with the holes 28 in the first wall member 26.

Figure 8:
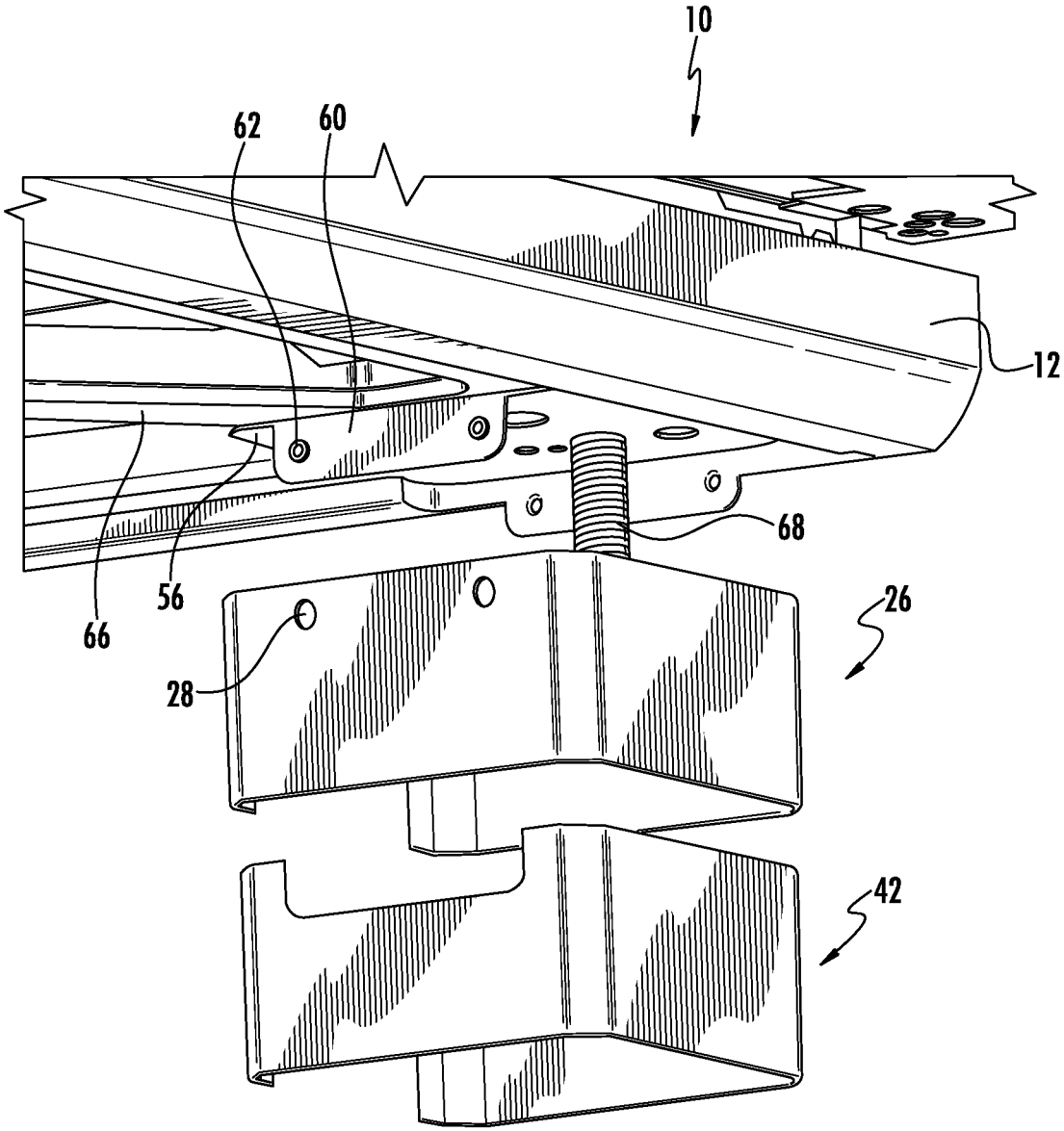
FIG. 8 is an exploded view of the support leg cover being mounted to a home appliance.

In operation, and with reference to FIG. 8, during assembly, the platform 56 is mounted to the range frame 66 with the threaded support member 68 projecting away from the platform 56 and the projections 62 projecting laterally away from the support walls 60 of the platform 56.

Figure 9:
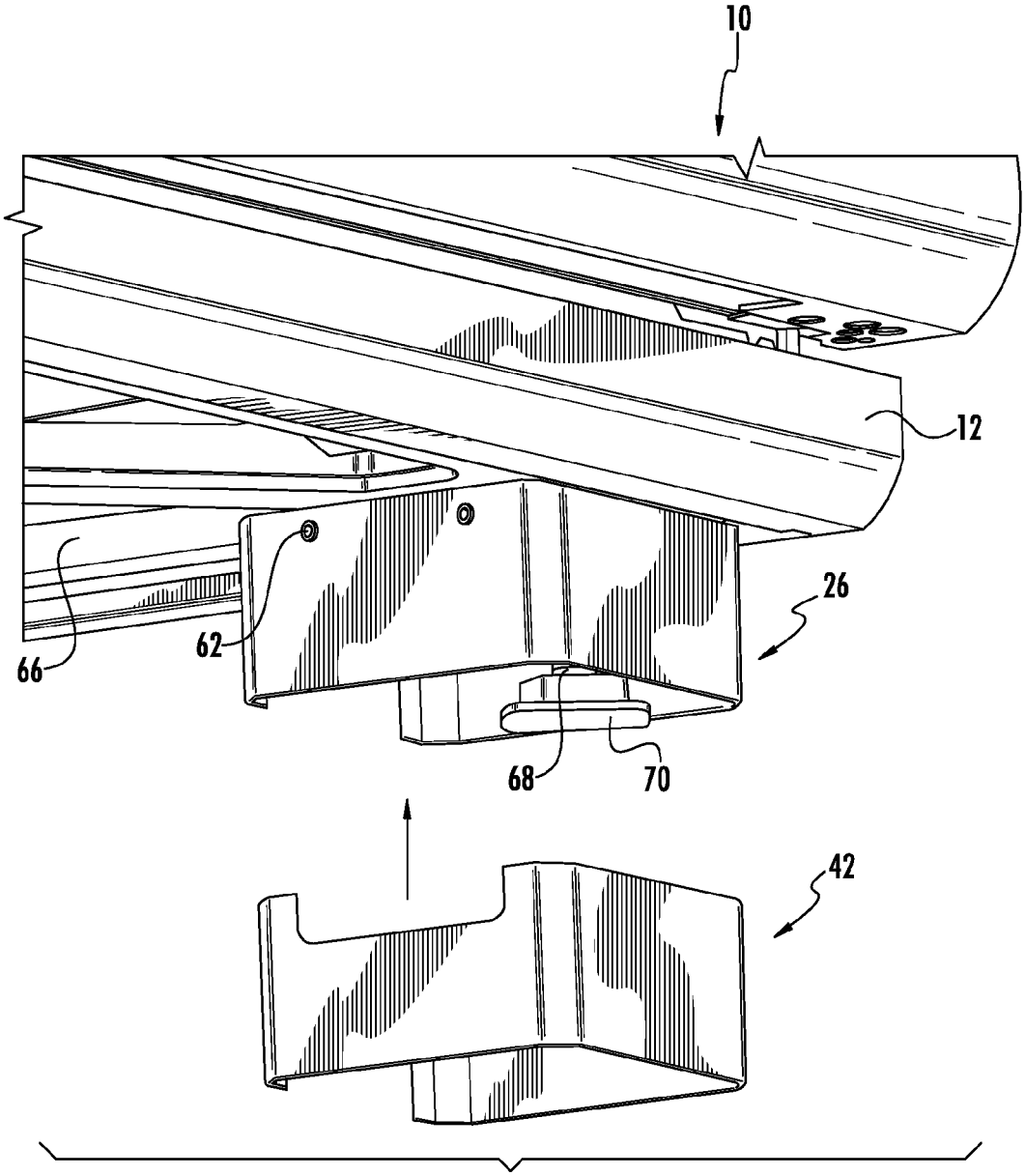
FIG. 9 is a perspective view of the support leg cover of FIG. 8 in a further stage of installation.

As seen in FIG. 9, the first wall member 26 is snapped onto the platform 56 with the projections 62. The second wall member 42 may be moved upwardly and telescoped into the first wall member 26 to provide the finished structure seen in FIG. 10.

Figure 10:
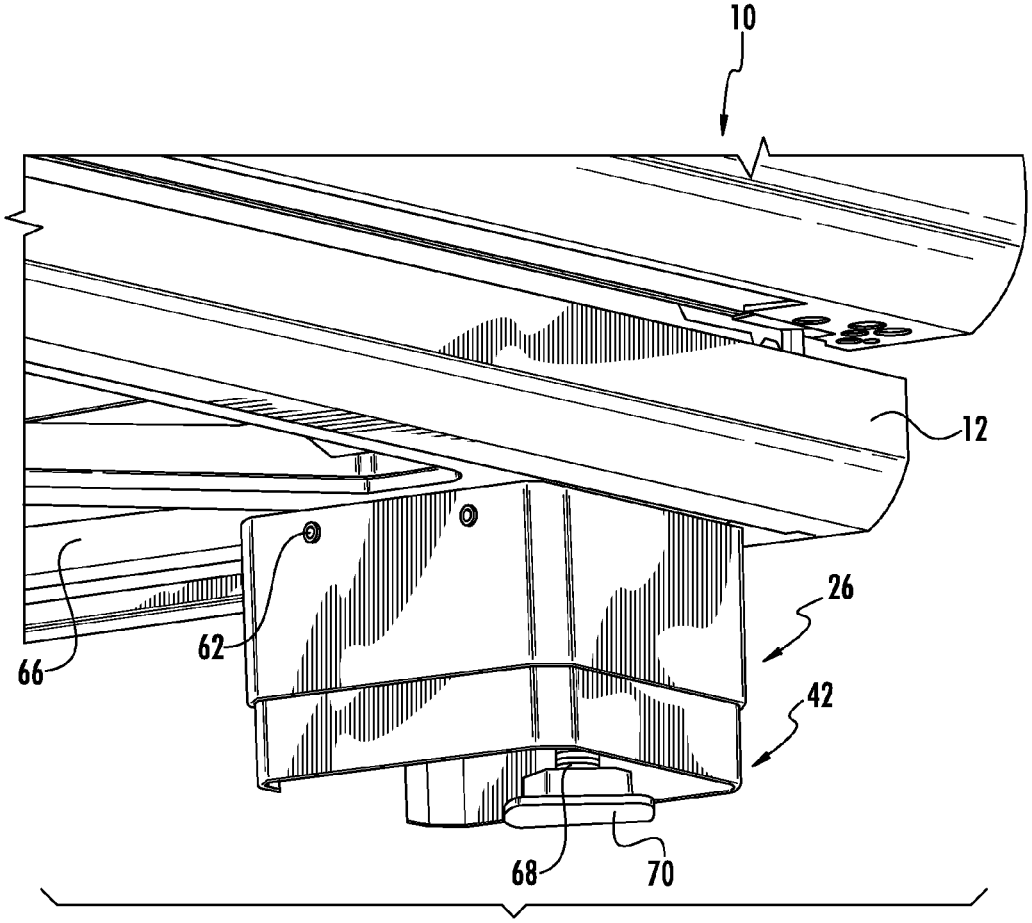
FIG. 10 is a perspective view of the support leg cover mounted to a home appliance.

In operation and with reference to FIG. 10, the wall members 26, 42 are assembled in a telescoping manner with the dual-wall assembly snapped onto the platform 56 after the range 10 is in place. Therefore, during installation of the range, the threaded support member 68 may be screwed inwardly or outwardly with respect to the frame 66 to achieve the desired range height prior to installation of the support leg cover 24 of the present invention. The assembly consisting of the first wall 26 with the second wall member 42 telescoped inside may then be snapped in place on the platform 56 mating the holes 28 in the first wall member 26 with the projections 62. The second wall member 42 may then be moved downwardly relative to the first wall member 26 to fully cover the support leg 68 and the support foot 70. This final action achieves the finished look seen in FIG. 2.

By the above, the present invention provides a home appliance in the form of a range that includes a support leg cover that can be attached without lifting or tilting the range and can be installed from the front. So long as the platform is installed, the open backs of the first wall member and the second wall member allow the wall members to be snapped into place on the platform from the front without lifting or tilting the range. Further, the second wall slips upwardly into the first wall and is out of the way when leveling the range. Alternately, the range can be leveled without any walls attached to the platform at all with the walls being attached after height adjustment is accomplished. The sliding nature of the second wall into the first wall provides a self-adjusting leg cover height. Further, the first wall member snaps into place without external fasteners using the projections on the platform walls and the holes in the first wall member. The present invention provides a home appliance with a support leg cover that is easy to install, conforms to different range heights and hides the leveling leg for a neat and finished appearance.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance supported for floor-standing operation, the home appliance comprising:

an appliance body;

a support member threadedly mounted to the appliance body for rigidly supporting the appliance on a support surface;

a plurality of projections attached to the appliance body adjacent the support member;

a first wall member attached to the plurality of projections and extending downwardly from the appliance body, wherein the first wall member is fixed in place to remain stationary relative to the support member and the appliance body; and a second wall member in contact with the first wall member and extending downwardly therefrom in a generally parallel relationship therewith, with the second wall member being configured for vertical movement relative to the first wall member, the appliance body and the support member, with the second wall member being movable independently of the support member to cover a side portion of the support member from the first wall member to the support surface, and wherein the first wall member covers a side portion of the support member from the appliance body to the second wall member.

2. The home appliance of claim 1 wherein the plurality of projections are mounted to a platform that is mounted to the appliance body adjacent the support member and extends in different directions away from the support member.

3. The home appliance of claim 2 and further comprising two projection supports extending downwardly from the platform with each of the projection supports having a projection mounted thereto for removable engagement with the first wall member.

4. The home appliance of claim 2 wherein the platform is a generally planar member mounted to the support member and having two side walls projecting downwardly from lateral edges thereof with the two side walls carrying the plurality of projections.

5. The home appliance of claim 4 wherein the first wall member has a plurality of holes configured for engagement with the plurality of projections, with one projection removably engaged with one hole in the first wall member.

6. The home appliance of claim 1 wherein the second wall member is telescopically attached to the first wall member for movement of the second wall member relative to the first wall member.

7. The home appliance of claim 1 wherein the first wall member includes a generally vertical front wall and two side walls projecting away from the front wall defining a structure having an open back.

8. The home appliance of claim 7 wherein the second wall member includes a generally vertical front wall and two side walls projecting away from the front wall defining a structure having an open back and the second wall member is received telescopically within the first wall member for sliding movement of the second wall member relative to the first wall member.

9. The home appliance of claim 1 wherein the second wall member includes a generally vertical front wall and two side walls projecting away from the front wall defining a structure having an open back.

10. The home appliance of claim 1 wherein the support member is vertically adjustable to provide height adjustment for the appliance and the second wall member is vertically movable to cover the support member over a plurality of appliance heights.

11. A range supported for floor-standing operation, the range comprising:

a range body;

a support member threadedly mounted to the range body for rigidly supporting the range on a support surface;

a plurality of projections attached to the range body adjacent the support member;

a first wall member attached to the plurality of projections and extending downwardly from the range body, wherein the first wall member is fixed in place to remain stationary relative to the support member and the range body; and a second wall member in contact with the first wall member and extending downwardly therefrom with the second wall member being configured for vertical movement relative to the first wall member, the range body and the support member, with the second wall member being movable independently of the support member to cover a side portion of the support member from the first wall member to the support surface, and wherein the first wall member covers a side portion of the support member from the range body to the second wall member.

12. The range of claim 11 wherein the plurality of projections are mounted to a platform that is mounted to the range body adjacent the support member and extends in different directions away from the support member.

13. The range of claim 12 and further comprising two projection supports extending downwardly from the platform with each of the projection supports having a projection mounted thereto for removable engagement with the first wall member.

14. The range of claim 12 wherein the platform is a generally planar member mounted to the support member and having two side walls projecting downwardly from lateral edges thereof with the two side walls carrying the plurality of projections.

15. The range of claim 14 wherein the first wall member has a plurality of holes configured for engagement with the plurality of projections, with one projection removably engaged with one hole in the first wall member.

16. The range of claim 11 wherein the second wall member is telescopically attached to the first wall member for movement of the second wall member relative to the first wall member.

17. The range of claim 11 wherein the first wall member includes a generally vertical front wall and two side walls projecting away from the front wall defining a structure having an open back.

18. The range of claim 17 wherein the second wall member includes a generally vertical front wall and two side walls projecting away from the front wall defining a structure having an open back and the second wall member is received telescopically within the first wall member for sliding movement of the second wall member relative to the first wall member.

19. The range of claim 11 wherein the second wall member includes a generally vertical front wall and two side walls projecting away from the front wall defining a structure having an open back.

20. The range of claim 11 wherein the support member is vertically adjustable to provide height adjustment for the range and the second wall member is vertically movable to cover the support member over a plurality of range heights.

* * * * *